US009192228B2

(12) United States Patent
Albanese

(10) Patent No.: US 9,192,228 B2
(45) Date of Patent: Nov. 24, 2015

(54) TABLE TOP EXPANDER

(71) Applicant: Benjamin Albanese, Brockton, MA (US)

(72) Inventor: Benjamin Albanese, Brockton, MA (US)

( * ) Notice: Subject to any disclaimer, the term of this patent is extended or adjusted under 35 U.S.C. 154(b) by 0 days.

(21) Appl. No.: 14/615,851

(22) Filed: Feb. 6, 2015

(65) Prior Publication Data

US 2015/0223597 A1 Aug. 13, 2015

Related U.S. Application Data

(60) Provisional application No. 61/938,263, filed on Feb. 11, 2014.

(51) Int. Cl.
*A47B 13/08* (2006.01)
*A47B 1/00* (2006.01)

(52) U.S. Cl.
CPC .. *A47B 1/00* (2013.01); *A47B 13/08* (2013.01)

(58) Field of Classification Search
CPC ..... A47B 1/00; A47B 13/081
USPC ..... 108/90
See application file for complete search history.

(56) References Cited

U.S. PATENT DOCUMENTS

| | | | | | |
|---|---|---|---|---|---|
| 796,855 | A | * | 8/1905 | Nurick | 108/90 |
| 826,669 | A | * | 7/1906 | Kindgen | 108/90 |
| 1,007,727 | A | * | 11/1911 | Onken | 108/90 |
| 1,413,111 | A | * | 4/1922 | Fricker | 108/90 |
| 1,575,954 | A | * | 3/1926 | Walaschek | 108/65 |
| 1,886,806 | A | * | 11/1932 | Hanley | 108/90 |
| 2,468,962 | A | * | 5/1949 | Czak | 108/90 |
| 2,542,649 | A | * | 2/1951 | Flowers | 220/293 |
| 2,556,943 | A | * | 6/1951 | Reisman | 108/90 |
| 2,634,183 | A | * | 4/1953 | Derman et al. | 108/90 |
| 2,723,891 | A | * | 11/1955 | Draxler | 108/137 |
| 2,837,390 | A | * | 6/1958 | Von Der Hellen | 108/137 |
| 4,003,320 | A | * | 1/1977 | Owens et al. | 108/158 |
| 2010/0139531 | A1 | | 6/2010 | Valeriote | |

* cited by examiner

*Primary Examiner* — Jose V Chen

(57) ABSTRACT

A table expander is provided. The table expander includes a table top. The table top includes a top surface, a bottom surface and an outer edge. The table expander further includes a plurality of clamps attached to the bottom surface of the table top. The clamps may be oriented near the outer edge of the table top and may be equidistant to one another. The present invention may include two, three or four clamps. The table top may be placed on a table so that the clamps are surrounding the edges of the table. The clamps may be secured to the table, thereby securing the table top to the table.

8 Claims, 4 Drawing Sheets

TABLE TOP EXPANDER

CROSS-REFERENCE TO RELATED APPLICATION

This application claims the benefit of priority of U.S. provisional application No. 61/938,263, filed Feb. 11, 2014, the contents of which are herein incorporated by reference.

BACKGROUND OF THE INVENTION

The present invention relates to tables and, more particularly, to a table top expander.

Dine in restaurants have seating areas in which tables and chairs are setup for patrons to eat within the restaurants. Popular restaurants may reach maximum capacity during breakfast, lunch or dinner hours. Additionally, an increase of large parties of five or more guests may seek a table in the restaurant during the popular restaurant hours. To cope, the restaurant may replace existing tables with a larger folding table. However, this is time consuming and creates chaos during a busy dining hour. Alternatively, the restaurant may have extendable tables. These are prohibitively expensive and difficult to relocate in a room.

As can be seen, there is a need for an improved table top expander.

SUMMARY OF THE INVENTION

In one aspect of the present invention, a table expander comprises: a table top comprising a top surface, a bottom surface, and an outer edge; a plurality of clamps attached to the bottom surface of the table top near the outer edge, wherein each of the clamps comprises: a base fixed to the bottom surface of the table top; a pivoting member pivotally attached to the base wherein the pivoting member is operable to pivot away from a center of the table top and pivot towards the center of the table top forming a gap comprising a distance in between the pivoting member and the bottom surface; and a clamping member operable to increase and decrease the distance between the pivoting member and the bottom surface.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a light weight table top that overlays an existing table. The present invention may be used in restaurants, function halls, conference rooms, schools, residential homes, and the like. Securing a 60" overlay table top on top of an existing 36" square table converts a four person table into a six or eight person table.

The present invention may include the following components. The round composite may be the base material for the table top. The laminate may be printed and applied to create the customizable top. The edging creates the finished edge around the table top. The circular puck clamps may be attached in the correct location on the bottom of the table top. Two to three pucks are placed in each location. Holes may be drilled in the pucks to receive the male and female screws and knobs. The top puck may rotate relative to the middle puck, the middle puck is used to improve stability, and the bottom puck is fixed. After the tabletop is installed, the top puck is turned until it is catching the underlying table top and the middle puck is used to tighten the overlay to the table making it more stable. The knob is then turned to tighten the top two pucks to the underlying table, thereby firmly securing the overlay to the underlay.

Figure 1:
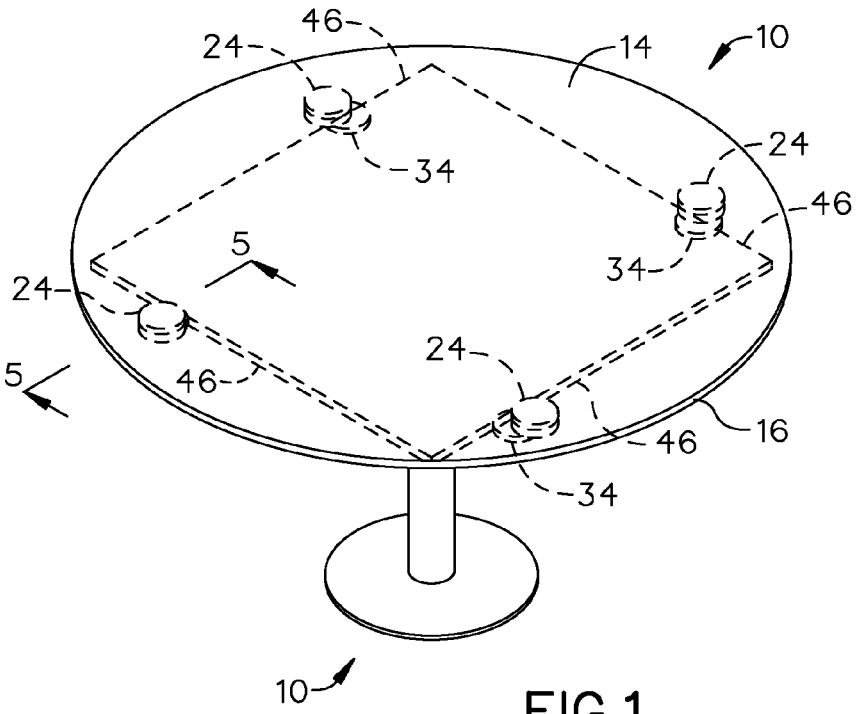
FIG. 1 is a top perspective view of an embodiment of the present invention, show in use.
Figure 2:
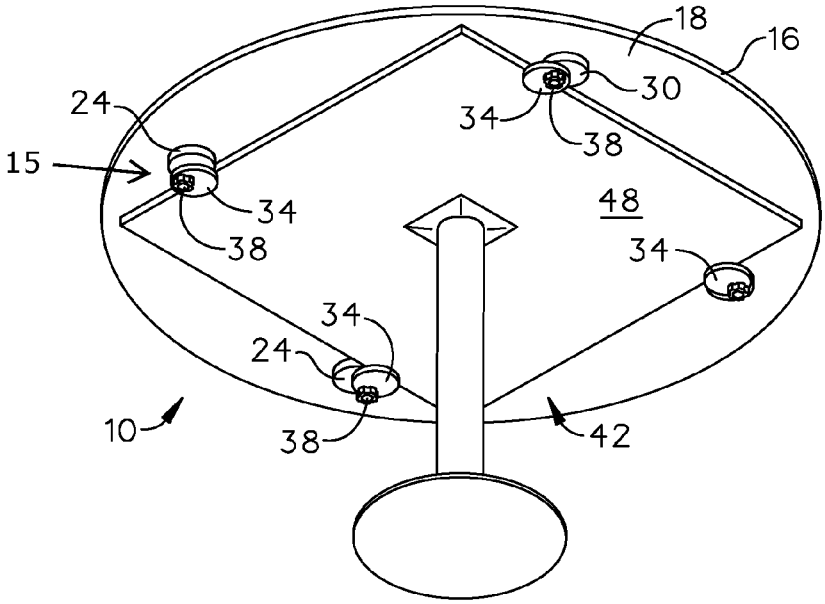
FIG. 2 is a bottom perspective view of an embodiment of the present invention, show in use.
Figure 3:
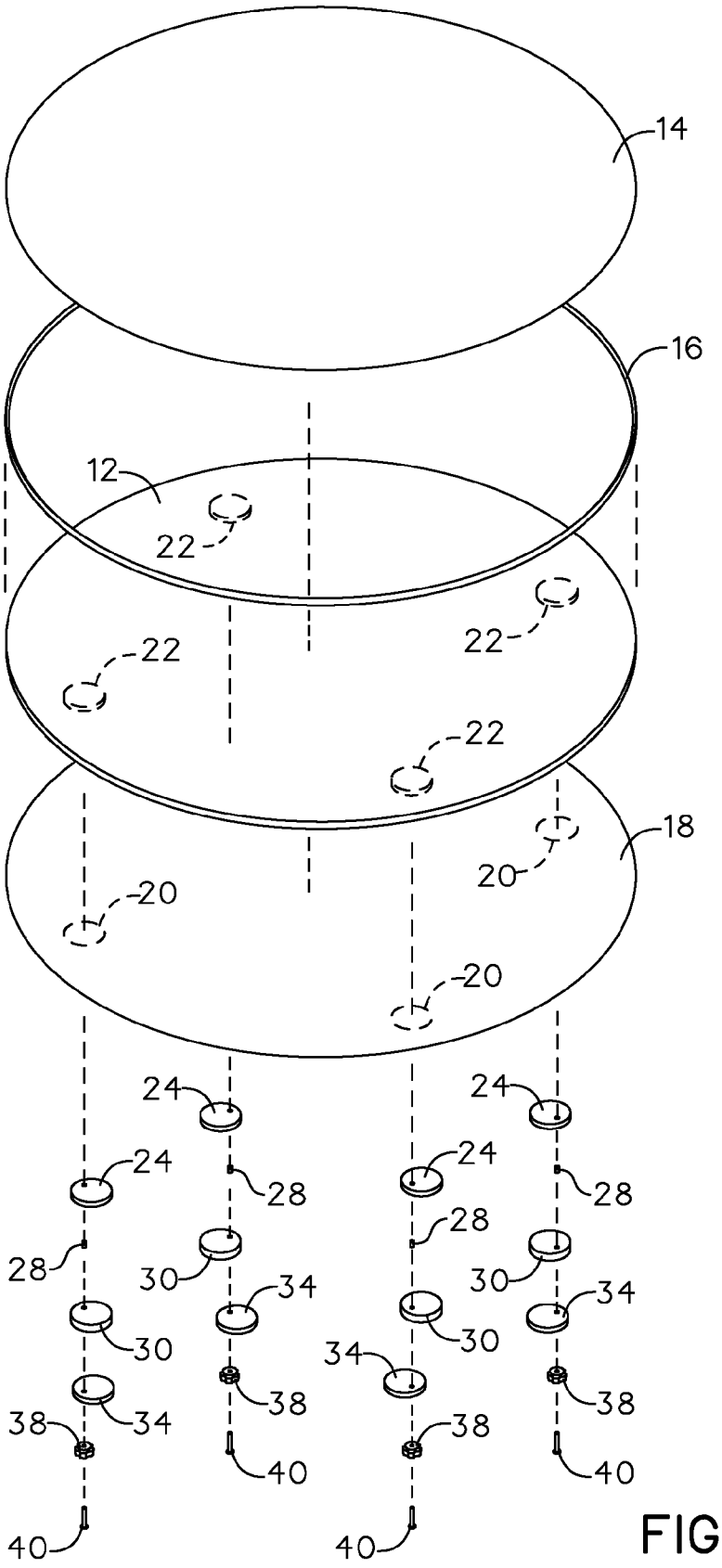
FIG. 3 is an exploded view of an embodiment of the present invention.
Figure 4:
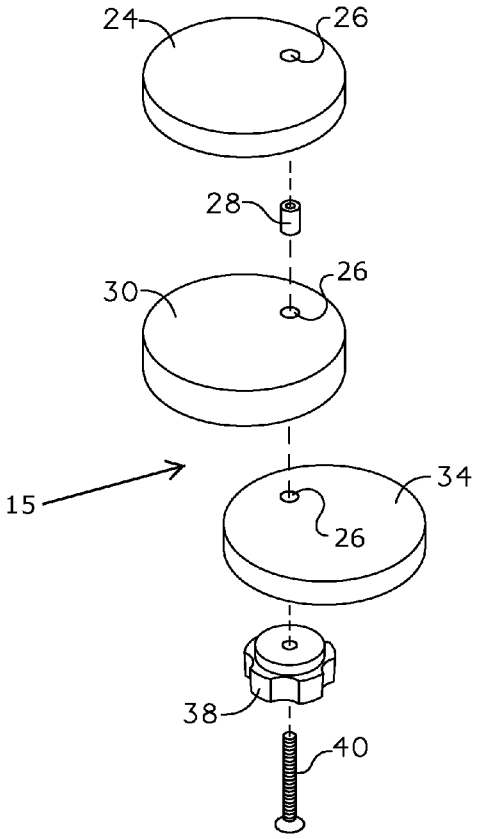
FIG. 4 is a detail exploded view of the present invention.
Figure 6:
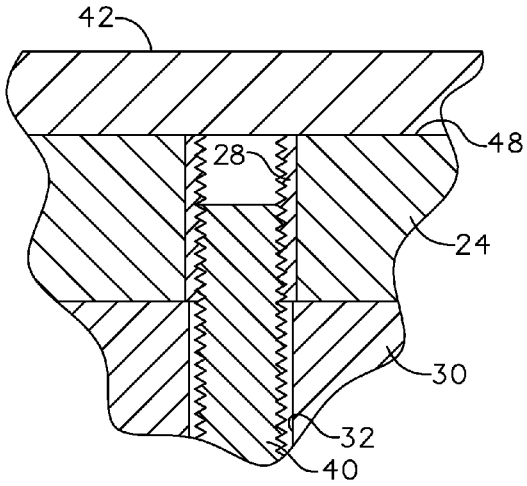
FIG. 6 is a detail view of FIG. 5.
Figure 5:
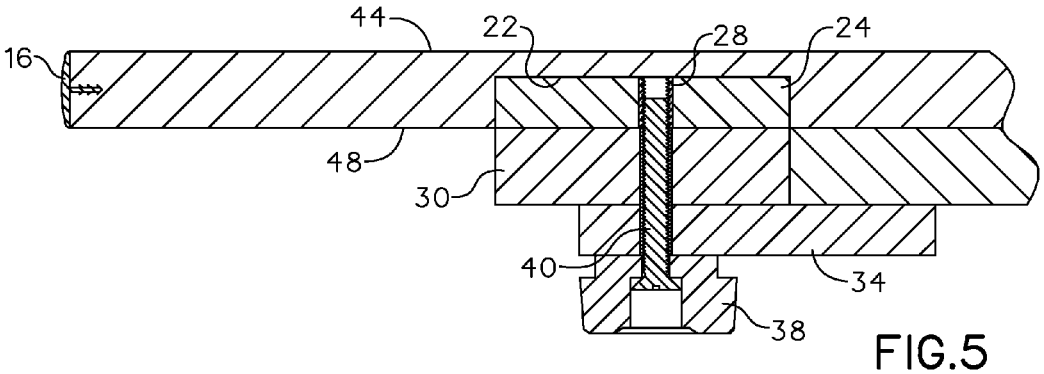
FIG. 5 is a section view of the present invention, taken along line 5-5 in FIG. 1.
Figure 7:
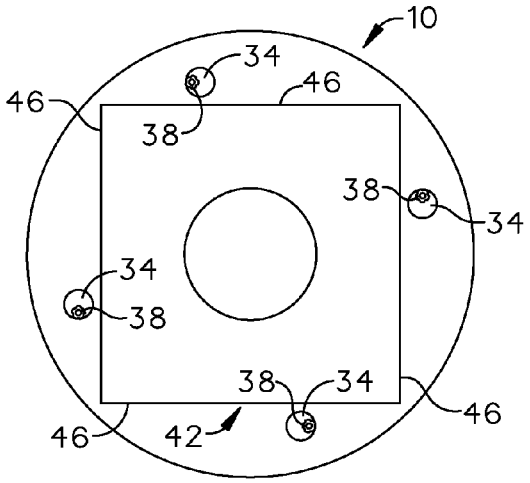
FIG. 7 is a bottom view of the present invention, illustrating the placement of the table top onto the table.
Figure 8:
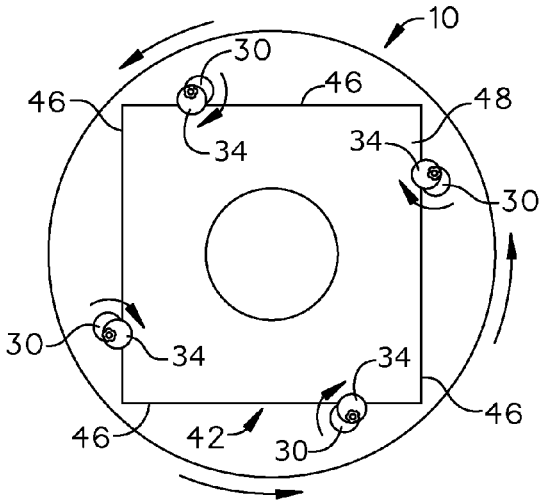
FIG. 8 is a bottom view of the present invention, illustrating the aligning of clamps with the table edges and the rotation of the clamps to engage the lower table surface.
Figure 9:
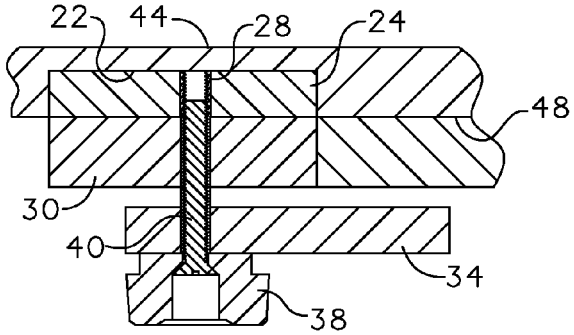
FIG. 9 is a section view of the present invention with the knob in the loosened position.
Figure 10:
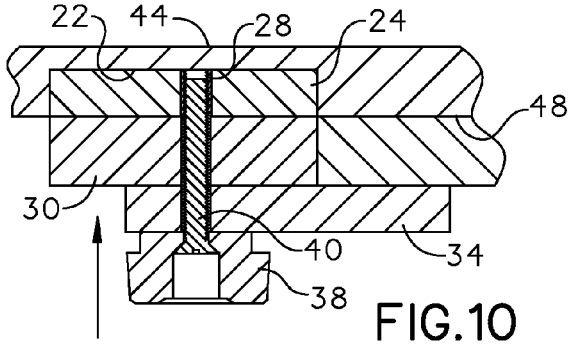
FIG. 10 is a section view of the present invention, illustration the tightening of knob.

Referring to FIGS. 1 through 10, the present invention includes a table expander. The table expander includes a table top 10. The table top 10 includes a top surface 44, a bottom surface 48 and an outer edge. The table expander further includes a plurality of clamps 15 attached to the bottom surface 48 of the table top 10. The clamps 15 may be oriented near the outer edge of the table top 10 and may be equidistant to one another. The present invention may include two, three or four clamps 15. The table top 10 may be placed on a table 42 so that the clamps 15 are surrounding the edges 46 of the table 42. The clamps 15 may be secured to the table 42, thereby securing the table top 10 to the table 42.

The clamps 15 of the present invention may include a base 30 fixed to the bottom surface 48 of the table top 10. A pivoting member 34 is pivotally attached to the base 30. The pivoting member 34 is operable to pivot away from the center of the table top 10 and pivot towards the center of the table top 10. When the pivoting member 34 is pivoted towards the center of the table top 10, a gap is formed between the pivoting member 34 and the bottom surface 48 of the table top 10. The table 42 may fit within the gap. A clamping member 38, 40 is operable to increase and decrease the distance between the pivoting member 34 and bottom surface 48, and thereby clamp the pivoting member 34 to the table 42.

In certain embodiments, the base 30 and the pivoting member 34 may be disc shaped, allowing for a smooth attachment of the table top 10 to the table 42. In certain embodiments, each clamp 15 may further include an upper disc 24. The upper disc 24 may fit within a disc recess 22 formed in the bottom surface 48 of the table top 10. The upper disc 24 may be fixed to the bottom surface 48 of the table 10 and the base 30 may be fixed to the upper disc 24.

The clamping member 38, 40 of the present invention may include a post 40 and a knob 38. The post 40 may include a threaded end. The pivoting member 34, the base 30 and the upper disc 24 may include aligning openings. The post 40 may fit through the aligning openings 26. The upper disc 24 may include a threaded insert 28. The threaded end of the post 40 may secure within the threaded insert 28. Therefore, the pivoting member 34 may pivot about the post 40 in a loosened position. The pivoting member 34 may pivot over the table 42 so that the table 42 is in between the pivoting member 34 and the table top 10. The knob 38 may be turned to tighten the pivoting member 34 against the table 42 and thereby secure the table top 10 to the table 42.

The table top 10 of the present invention may include an upper laminate sheet 14, a composite material layer 12, and a lower laminate sheet 18. The upper laminate sheet 14 may be custom designed to match the table 42 in which it is being secured to. The composite material includes the disc recesses 22 to fit the upper discs 24 within. The lower laminate sheet 18 includes openings 20 aligning with the disc recesses 22. A t-molding layer 16 is about a perimeter of the table top 10, and provides and aesthetic finish. Larger and smaller sizes of the composite 12 can be used to fit larger or smaller underlying tables 42 giving the table tops 10 the ability to solve the seating capacity for virtually any existing table that needs to accommodate more seating than it was originally designed for. The clamps 12 may shift positions to accommodate those differing sizes.

A method of using the present invention may include the following. To start, the pivoting members 34 may align with the base 30 so that the table top 10 may be easily placed on the table 42. Once the table top 10 is placed on the table 42, the table top 10 is rotated so that the clamps 15 are pressed against the edge 46 of the table 42. The knobs 38 may be rotated to loosen the pivoting members 34, allowing the pivoting members 34 to pivot. The pivoting members 34 may be pivoted so that the table 42 is in between the pivoting members 34 and the bottom surface 48 of the table top 10. The knobs 38 may be rotated the opposite way to tighten the pivoting members 34 against the table 42, securing the table top 10 to the table 42.

It should be understood, of course, that the foregoing relates to exemplary embodiments of the invention and that modifications may be made without departing from the spirit and scope of the invention as set forth in the following claims.

What is claimed is:

1. A table expander comprising:

a table top comprising a top surface, a bottom surface, and an outer edge;

a plurality of clamps attached to the bottom surface of the table top, wherein each of the clamps comprises:

a base fixed to the bottom surface of the table top;

a pivoting member pivotally attached to the base such that the base is disposed in between the pivoting member and the bottom surface of the table top, wherein the pivoting member pivots about a vertical axis running through the base and the pivoting member; and a clamping member operable to vertically adjust a distance between the pivoting member and the bottom surface of the table top, wherein the pivoting member comprises a first position comprising the pivoting member pivoted towards the base and a second position comprising the pivoting member pivoted away from and disposed beyond an edge of the base, thereby forming a gap in between the pivoting member and the bottom surface of the table top.

2. The table expander of claim 1, wherein the base and the pivoting member are disc shaped.

3. The table expander of claim 1, wherein the clamping member comprises a post comprising a threaded first end, and a knob attached to an opposing end, wherein the post runs through aligning apertures of the base and the pivoting member and the threaded first end mates with a threaded insert of the table.

4. The table expander of claim 3, further comprising a plurality of upper discs each mounted within a disc recess formed in the bottom surface, wherein each of the upper disc comprises the threaded insert.

5. The table expander of claim 4, wherein the table top comprises an upper laminate sheet, a composite material layer comprising the disc recesses, and a lower laminate sheet comprising openings aligning with the disc recesses, wherein a t-molding layer is about a perimeter of the table top.

6. The table expander of claim 1, wherein the plurality of clamps is two clamps located on opposite sides of the bottom surface.

7. The table expander of claim 1, wherein the plurality of clamps is four clamps equidistant from one another.

8. The table expander of claim 1, wherein the plurality of clamps is three clamps.

* * * * *